US010631709B2

(12) United States Patent
Boyer

(10) Patent No.: US 10,631,709 B2
(45) Date of Patent: Apr. 28, 2020

(54) HEATING ASSEMBLY FOR A WASHING APPLIANCE

(71) Applicant: Haier US Appliance Solutions, Inc., Wilmington, DE (US)

(72) Inventor: Joel Charles Boyer, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 203 days.

(21) Appl. No.: 15/635,343

(22) Filed: Jun. 28, 2017

(65) Prior Publication Data

US 2019/0000296 A1 Jan. 3, 2019

(51) Int. Cl.

| | |
|---|---|
| ***A47L 15/42*** | (2006.01) |
| ***A47L 15/22*** | (2006.01) |
| ***A47L 15/50*** | (2006.01) |

(52) U.S. Cl.

CPC ..... *A47L 15/4285* (2013.01); *A47L 15/22* (2013.01); *A47L 15/4221* (2013.01); *A47L 15/4225* (2013.01); *A47L 15/4293* (2013.01); *A47L 15/502* (2013.01); *A47L 15/507* (2013.01)

(58) Field of Classification Search

CPC .. A47L 15/4285; A47L 15/22; A47L 15/4221; A47L 15/4293; A47L 15/507; A47L 15/502; A47L 15/4225

See application file for complete search history.

(56) References Cited

U.S. PATENT DOCUMENTS

| | | | | |
|---|---|---|---|---|
| 4,326,552 | A | 4/1982 | Bleckmann | |
| 5,138,693 | A * | 8/1992 | Knauss | A47J 27/024 134/107 |
| 7,905,239 | B2 * | 3/2011 | Kim | B05B 7/1646 134/95.2 |
| 9,113,766 | B2 | 8/2015 | Tuller et al. | |
| 2007/0079851 | A1 * | 4/2007 | Park | A47L 15/4234 134/56 D |
| 2007/0241100 | A1 * | 10/2007 | Stickel | A47J 31/545 219/543 |

(Continued)

FOREIGN PATENT DOCUMENTS

| | | | |
|---|---|---|---|
| EP | 2075366 | A1 | 7/2009 |
| FR | 2491321 | A1 | 4/1982 |

*Primary Examiner* — Benjamin L Osterhout

(74) *Attorney, Agent, or Firm* — Dority & Manning, P.A.

(57) ABSTRACT

A dishwashing appliance includes a tub, a fluid circulation system, and a heating assembly positioned outside of the tub. The heating assembly includes a housing and a tubular heating element disposed within the housing. The tubular heating element includes an inner surface and an outer surface. The inner surface of the tubular heating element defines a first passage in fluid communication with the fluid circulation system. The outer surface of the tubular heating element is spaced apart from an inner surface of the housing such that a second passage is defined between the outer surface of the tubular heating element and the inner surface of the housing. The second passage is in fluid communication with the tub. A resistive heating material is disposed on the outer surface of the tubular heating element. The resistive heating material is configured to provide thermal energy to the first passage and the second passage.

14 Claims, 4 Drawing Sheets

(56) References Cited

U.S. PATENT DOCUMENTS

| | | | | |
|---|---|---|---|---|
| 2011/0290284 | A1* | 12/2011 | Chung | A47L 15/4206<br>134/104.2 |
| 2012/0279527 | A1* | 11/2012 | Lee | A47L 15/0036<br>134/106 |
| 2016/0051122 | A1* | 2/2016 | Lee | A47L 15/4234<br>134/57 D |

* cited by examiner

HEATING ASSEMBLY FOR A WASHING APPLIANCE

FIELD

The present subject matter relates generally to washing appliances, such as dishwashing appliances and, more particularly, to a heating assembly of a washing appliance.

BACKGROUND

Dishwashing appliances generally include a tub that defines a wash chamber. Rack assemblies can be mounted within the wash chamber for receipt of articles for washing. In addition, spray-arm assemblies within the wash chamber may be used to apply or direct fluid towards the articles disposed within the rack assemblies in order to clean such articles. As is generally understood, dishwashing appliances may often include multiple spray-arm assemblies, such as a lower spray-arm assembly mounted to the tub at a bottom of the wash chamber, a mid-level spray-arm assembly mounted to one of the rack assemblies, and/or an upper spray-arm assembly mounted to the tub at a top of the wash chamber.

Moreover, dishwashing appliances are typically equipped with a fluid circulation system including a plurality of fluid circulation components for directing fluid to the spray-arm assemblies. Specifically, a pump is typically housed within a machine compartment of the dishwasher that is configured to pump fluid along a circulation flow path for subsequent delivery to the spray-arm assemblies. For example, the fluid discharged from the pump may be routed through a diverter assembly and/or one or more fluid conduits disposed along the circulation flow path prior to being delivered to the spray-arm assemblies.

To provide for desired cleaning performance, the fluid directed through the fluid circulation system is often heated. Conventionally, such heating of the fluid has been accomplished by adding separate heating devices along the circulation flow path through which the fluid is passed. Unfortunately, such separate heating devices add significant costs and also occupy valuable space within the dishwashing appliance. To address these issues, manufacturers have attempted to integrate heating rods and film resistors into the components of the fluid circulation system, such as by integrating such heating components into the dishwasher pump. However, the integration of such components typically results in unnecessarily high manufacturing costs and/or requires the use of complex manufacturing processes for sealing the heating component within the fluid circulation component.

Accordingly, an improved heating assembly for a washing appliance that addresses one or more of the issues highlighted above in the prior art would be welcomed in the technology.

BRIEF DESCRIPTION

Aspects and advantages of the technology will be set forth in part in the following description, or may be obvious from the description, or may be learned through practice of the technology.

In one aspect, the present subject matter is directed to a dishwashing appliance. The dishwashing appliance includes a tub defining a wash chamber, at least one spray-arm assembly positioned within the wash chamber, a fluid circulation system configured to deliver fluid to the at least one spray-arm assembly and a heating assembly positioned outside of the tub. The heating assembly includes a housing and a tubular heating element disposed within the housing. The tubular heating element includes an inner surface and an outer surface. The inner surface of the tubular heating element defines a first passage in fluid communication with the fluid circulation system. The outer surface of the tubular heating element is spaced apart from an inner surface of the housing such that a second passage is defined between the outer surface of the tubular heating element and the inner surface of the housing. The second passage in fluid communication with the tub. A resistive heating material is disposed on the outer surface of the tubular heating element. The resistive heating material is configured to provide thermal energy to the first passage and the second passage.

In another aspect, the present subject matter is directed to a heating assembly. The heating assembly includes a housing and a tubular heating element disposed within the housing. The tubular heating element includes an inner surface and an outer surface. The inner surface of the tubular heating element defines a first passage. The outer surface of the tubular heating element is spaced apart from an inner surface of the housing such that a second passage is defined between the outer surface of the tubular heating element and the inner surface of the housing. A resistive heating material is disposed on the outer surface of the tubular heating element. The resistive heating material is configured to provide thermal energy to the first passage and the second passage.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
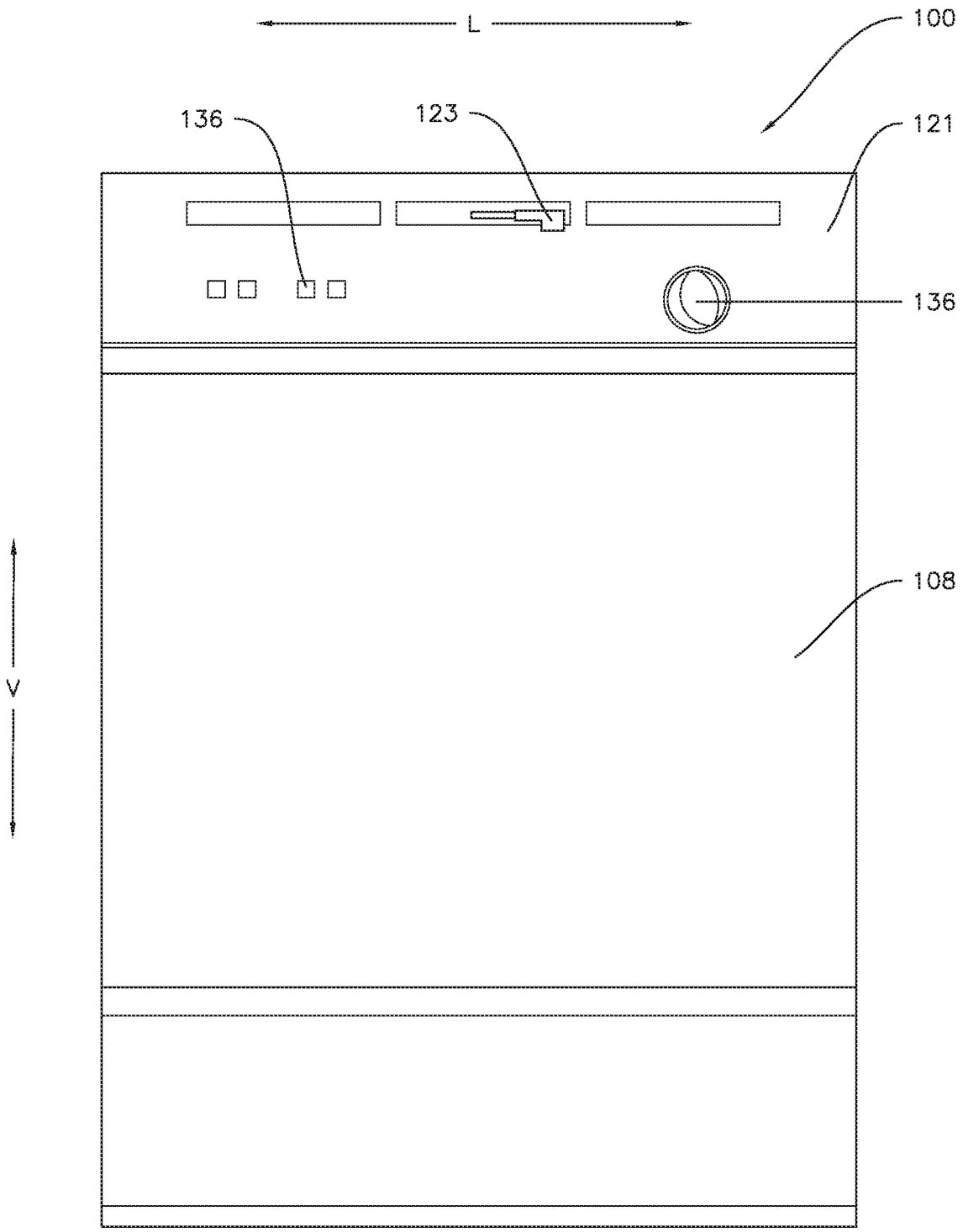
FIG. 1 illustrates a front view of one embodiment of a dishwashing appliance as may incorporate one or more embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
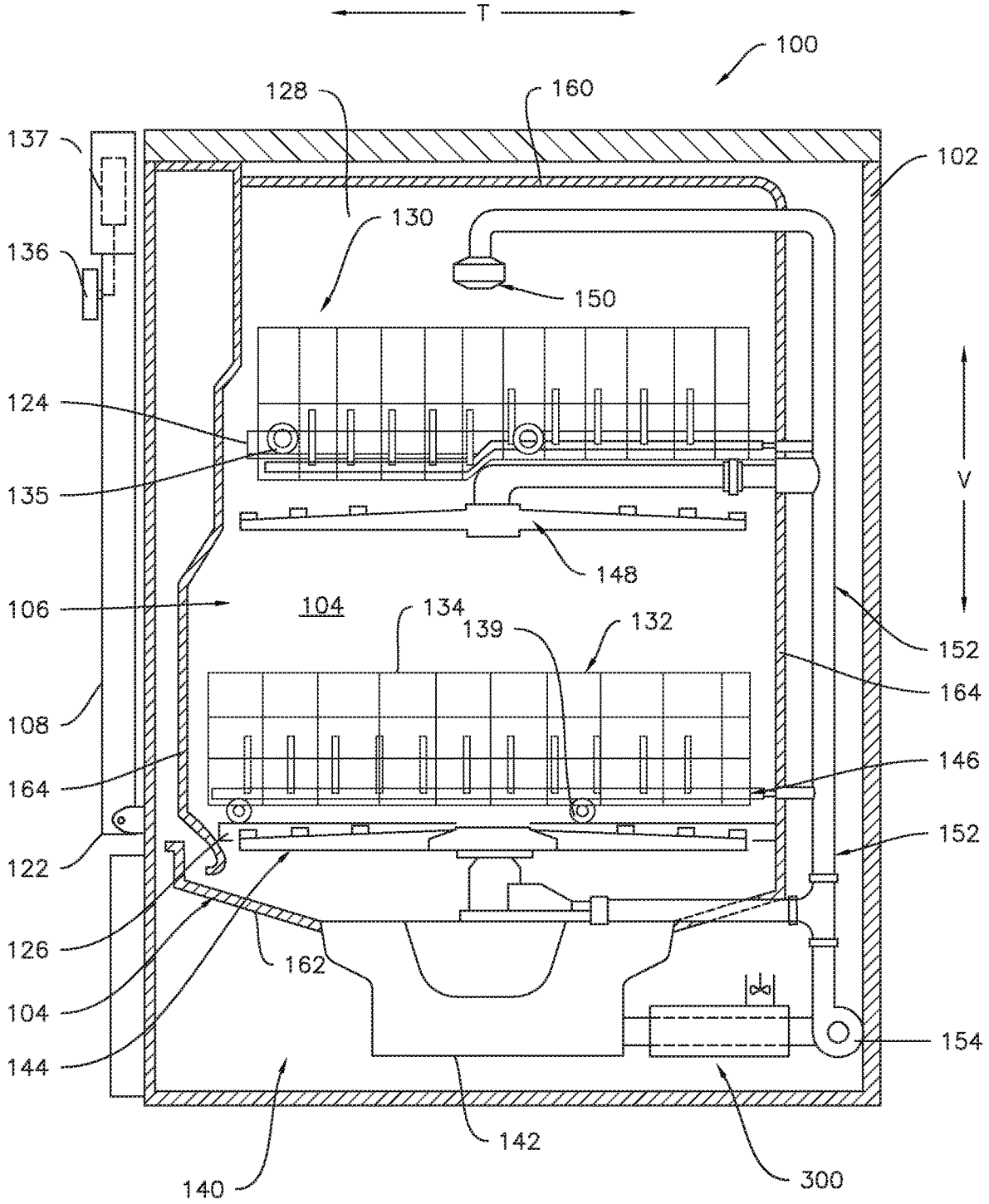
FIG. 2 illustrates a cross-sectional side view of the dishwashing appliance shown in FIG. 1, particularly illustrating various internal components of the dishwashing appliance.

Referring now to the drawings, FIGS. 1 and 2 illustrate one embodiment of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. As shown in FIG. 1, a latch 123 may be used to lock and unlock the door 108 for access to the chamber 106.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., four sidewalls) extending between the top and bottom walls 160, 162. It should be appreciated that the tub 104 may generally be formed from any suitable material. However, in several embodiments, the tub 104 may be formed from a ferritic material, such as stainless steel, or a polymeric material.

As particularly shown in FIG. 2, upper and lower guide rails 124, 126 may be mounted on opposing side walls 164 of the tub 104 and may be configured to accommodate roller-equipped rack assemblies 130 and 132. Each of the rack assemblies 130, 132 may be fabricated into lattice structures including a plurality of elongated members 134 (for clarity of illustration, not all elongated members making up assemblies 130 and 132 are shown in FIG. 2). Additionally, each rack 130, 132 may be adapted for movement along a transverse direction T between an extended loading position (not shown) in which the rack is substantially positioned outside the wash chamber 106, and a retracted position (shown in FIGS. 1 and 2) in which the rack is located inside the wash chamber 106. This may be facilitated by rollers 135 and 139, for example, mounted onto racks 130 and 132, respectively. As is generally understood, a silverware basket (not shown) may be removably attached to rack assembly 132 for placement of silverware, utensils, and the like, that are otherwise too small to be accommodated by the racks 130, 132.

Additionally, the dishwashing appliance 100 may also include a lower spray-arm assembly 144 that is configured to be rotatably mounted within a lower region 146 of the wash chamber 106 directly above the bottom wall 162 of the tub 104 so as to rotate in relatively close proximity to the rack assembly 132. As shown in FIG. 2, a mid-level spray-arm assembly 148 may be located in an upper region of the wash chamber 106, such as by being located in close proximity to the upper rack 130. Moreover, an upper spray assembly 150 may be located above the upper rack 130.

As is generally understood, the lower and mid-level spray-arm assemblies 144, 148 and the upper spray assembly 150 may generally form part of a fluid circulation system 152 for circulating fluid (e.g., water and dishwasher fluid) within the tub 104. As shown in FIG. 2, the fluid circulation system 152 may also include a pump 154 located in a machinery compartment 140 below the bottom wall 162 of the tub 104, as is generally recognized in the art, and one or more fluid conduits for circulating the fluid delivered from the pump 154 to and/or throughout the wash chamber 106. The recirculation pump 154 receives fluid from sump 142 to provide a flow to fluid circulation system 152, which may include a switching valve or diverter (not shown) to select flow to one or more of the lower and mid-level spray-arm assemblies 144, 148 and the upper spray assembly 150.

Moreover, each spray-arm assembly 144, 148 may include an arrangement of discharge ports or orifices for directing washing liquid onto dishes or other articles located in rack assemblies 130 and 132, which may provide a rotational force by virtue of washing fluid flowing through the discharge ports. The resultant rotation of the lower spray-arm assembly 144 provides coverage of dishes and other dishwasher contents with a washing spray.

The dishwashing appliance 100 may be further equipped with a controller 137 configured to regulate operation of the dishwasher 100. The controller 137 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor.

The controller 137 may be positioned in a variety of locations throughout dishwashing appliance 100. In the illustrated embodiment, the controller 137 is located within a control panel area 121 of the door 108, as shown in FIG. 1. In such an embodiment, input/output ("I/O") signals may be routed between the control system and various operational components of the dishwashing appliance 100 along wiring harnesses that may be routed through the bottom of the door 108. Typically, the controller 137 includes a user interface panel/controls 136 through which a user may select various operational features and modes and monitor progress of the dishwasher 100. In one embodiment, the user interface 136 may represent a general purpose I/O ("GPIO") device or functional block. Additionally, the user interface 136 may include input components, such as one or more of a variety of electrical, mechanical or electro-mechanical input devices including rotary dials, push buttons, and touch pads. The user interface 136 may also include a display component, such as a digital or analog display device designed to provide operational feedback to a user. As is generally understood, the user interface 136 may be in communication with the controller 137 via one or more signal lines or shared communication busses.

It should be appreciated that the present subject matter is not limited to any particular style, model, or configuration of dishwashing appliance. The exemplary embodiment depicted in FIGS. 1 and 2 is simply provided for illustrative purposes only. For example, different locations may be provided for the user interface 136, different configurations may be provided for the racks 130, 132, and other differences may be applied as well.

Figure 3:
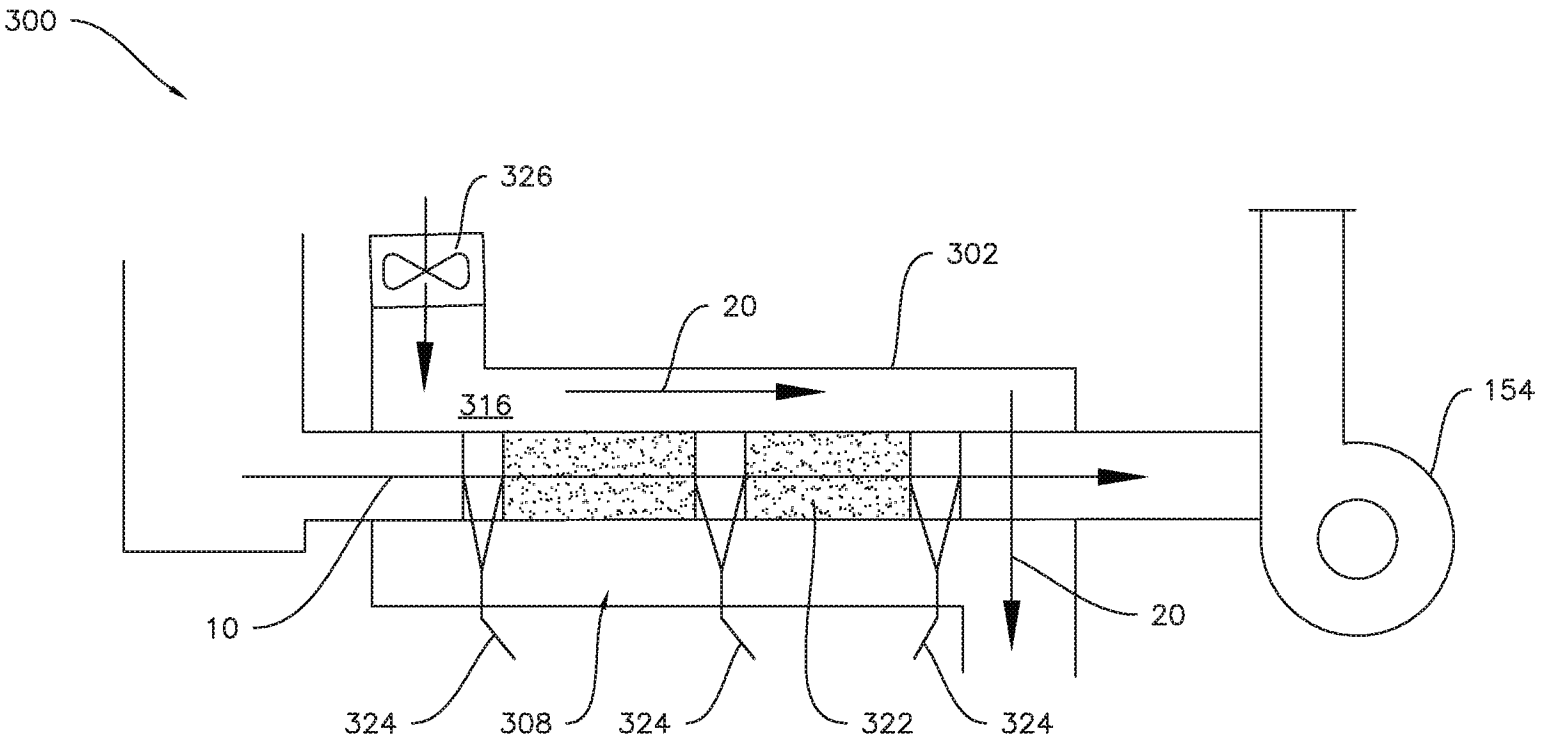
FIG. 3 provides a schematic view of an integrated dual-purpose hidden heater according to one or more embodiments of the present subject matter.

As shown in FIG. 2, the dishwashing appliance 100 may include a heating assembly 300. For example, the heating assembly 300 may be a hidden heating assembly in that the heating assembly 300 may be positioned within the cabinet 102 but outside of the tub 104, such as in the machinery compartment 140. FIG. 3 schematically illustrates an exemplary embodiment of the heating assembly 300. As seen in FIG. 3, the heating assembly 300 may include a housing 302 and a tubular heating element 308 disposed within the housing 302. The tubular heating element 308 may define a first passage 314 (FIG. 4) inside the tubular heating element 308. In some embodiments, the first passage 314 may be in fluid communication with the fluid circulation system 152, such that first fluid 10 may flow through the first passage 314 within the tubular heating element 308. The first fluid 10 may be in a liquid state, e.g., water, detergent, and/or other additives, which are collectively referred to as wash liquor. The tubular heating element 308 may be spaced apart from the housing 302 such that a second passage 316 is defined between the tubular heating element 308 and the housing 302. Thus, the heating assembly 300 may be an integrated heating assembly in that the first passage 314 and second passage 316 are integrally formed within the heating assembly 300. The second passage 316 may be in fluid communication with the tub 104, e.g., to provide ventilation of the tub 104. Thus, for example, a second fluid 20 may flow through the second passage 316 and the second fluid 20 may be predominantly in a gaseous state, e.g., the second fluid 20 may include air and/or water vapor, among other gases, emitted from the tub 104 during the operation of the dishwasher appliance 100. A fan 326 may be provided in fluid communication with the second passage 316 to urge the second fluid 20 through the second passage 316.

Still with reference to FIG. 3, the tubular heating element 308 may be a resistive heating element. In such embodiments, the tubular heating element 308 may include a resistive heating material 322 disposed on the tubular heating element 308. The resistive heating material 322 may be configured to heat the first fluid 10 and the second fluid 20, e.g., the resistive heating material 322 may be configured to provide thermal energy to the first passage 314 and the second passage 316 to heat the fluids 10 and 20 as the fluids 10 and 20 flow through the respective passages 314 and 316. Thus, the heating assembly 300 may be a dual-purpose heating assembly in that the heating assembly 300 provides heat to both the first fluid 10 and the second fluid 20. In some embodiments, the heating assembly 300 may simultaneously provide heat to both the first fluid 10 and the second fluid 20. The resistive heating material 322 may be disposed on the tubular heating element 308 by any suitable manufacturing method, for example by particle vapor deposition.

As indicated above, the resistive heating material 322 may be configured to provide thermal energy to the first passage 314 and the second passage 316. In general, the resistive heating material 322 may comprise any suitable resistive material that generates heat energy when an electrical current is transmitted therethrough. For example, suitable resistive heating materials may include, but are not limited to, certain ceramic materials (e.g., aluminum oxide and chromium oxide), aluminum, copper, carbon, steel alloys and/or the like.

An electrical current may be transmitted through the resistive heating material 322 from a plurality of conductive rings 320 on the tubular heating element 308. The conductive rings 320 may include any suitable material, for example a metallic material such as chrome. As illustrated in FIG. 3, in some embodiments, three conductive rings 320 may be provided. The resistive heating material 322 may extend between the conductive rings 320. The conductive rings 320 may be connected to a power source (not shown) via electrical connections 324. The electrical connections 324 may include any suitable combination of positive, negative, neutral and/or ground connections, so long as the electrical connections 324 and conductive rings 320 provide an equally distributed voltage to the resistive heating material 322. In general, the power source may correspond to any suitable electrical device and/or component or other source of electrical power that is configured to deliver an electrical current to the conductive rings 320 and through the resistive heating material 322, thereby allowing the heating assembly 300 to generate heat. For example, the power source may correspond to the main power source (not shown) for the washing appliance within which the heating assembly 300 is being used (e.g., the power source for the dishwashing appliance 100 shown in FIGS. 1 and 2). Alternatively, the power source may correspond to an electrical circuit or any other component that is electrically coupled between the conductive rings 320 and the main power source for the washing appliance. The structure and function of such power sources and electrical components are generally understood in the art and are not described in further detail herein.

During use of the heating assembly 300, a suitable current may be supplied from the power source to the conductive rings 320 and thereby through the resistive heating material 322 between the conductive rings 320. Due to its resistive properties, the resistive heating material 322 may generate thermal energy as the current passes through the resistive heating material 322. The heat generated by the resistive heating material 322 may then be transferred radially through the heating assembly 300. In this regard, at least a portion of the heat generated by the resistive heating material 322 may be transferred radially inwardly through the tubular heating element 308 to increase the temperature of the first fluid 10 passing through the first passage 314 (FIG. 4), and at least a portion of the heat generated by the resistive heating material 322 may be transferred radially outwardly from the tubular heating element 308 to increase the temperature of the second fluid 20 passing through the second passage 316.

Figure 4:
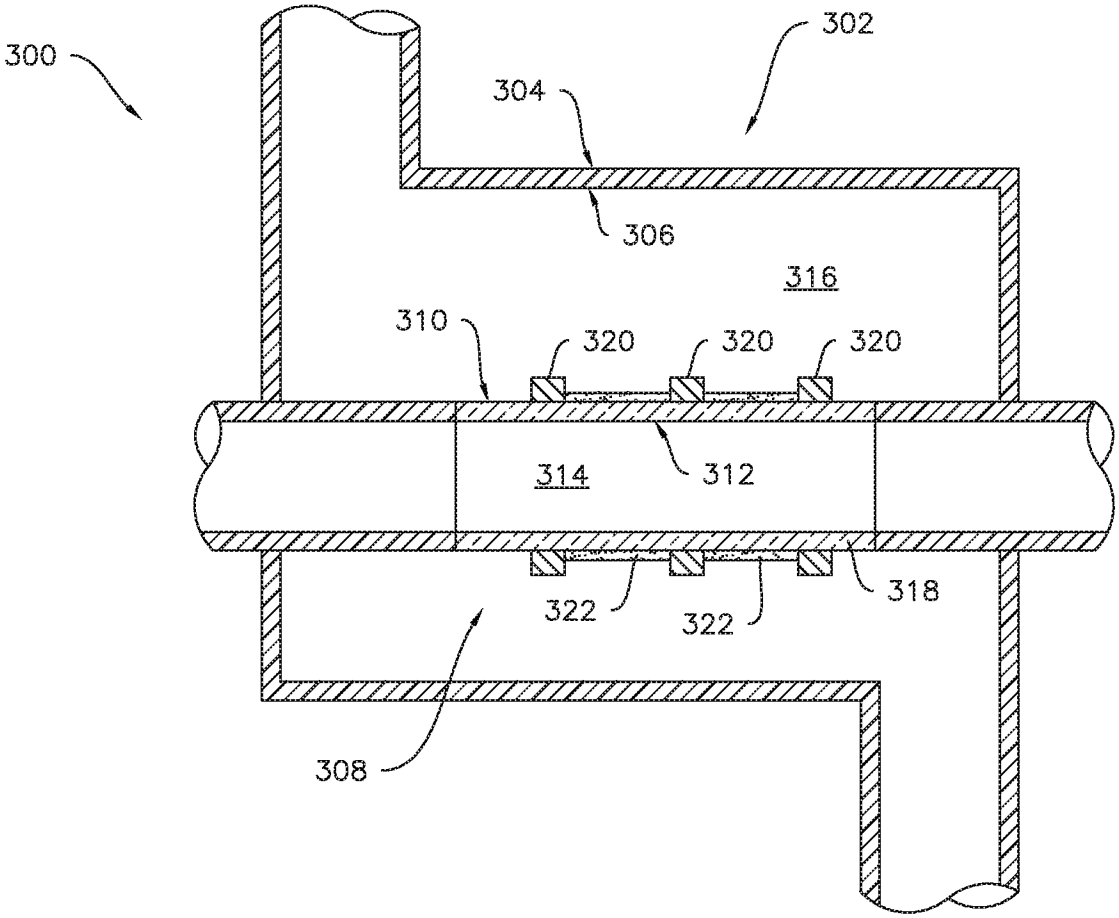
FIG. 4 provides a cross-sectional view of an integrated dual-purpose hidden heater according to one or more embodiments of the present subject matter.

Turning now to FIG. 4, the housing 302 may include an outer surface 304 and an inner surface 306. The tubular heating element 308 may include an outer surface 310 and an inner surface 312. The first passage 314 may be defined within the tubular heating element 308 by the inner surface 312 of the tubular heating element 308. The tubular heating element 308 may be disposed within the housing 302 such that the outer surface 310 of the tubular heating element 308 faces and is at least partially surrounded by the inner surface 306 of the housing 302. Further, the outer surface 310 of the tubular heating element 308 may be spaced apart from the inner surface 306 of the housing 302 such that the second passage 316 is defined between the outer surface 310 of the tubular heating element 308 and the inner surface 306 of the housing 302.

The resistive heating material 322 may be disposed on the outer surface 310 of the tubular heating element 308. Further, in such embodiments, the conductive rings 320 may be positioned on the outer surface 310 of the tubular heating element 308. The tubular heating element 308 may include a substrate 318. In such embodiments, at least the inner surface 312 of the tubular heating element 308 may be defined by the substrate 318. As illustrated for example in FIG. 4, the inner surface 312 of the tubular heating element 308 may be an internal side of the substrate 318 and the outer surface 310 may be an external side of the substrate 318 opposite of the inner surface 312. The substrate 318 may include any suitable material, for example, glass, such as tempered glass.

As noted above, the second fluid 20 which may flow through the second passage 316 during operation of the dishwashing appliance 100 may be predominantly in a gaseous state. Accordingly, the resistive heating material 322 and the conductive rings 320 may be exposed to the second passage 316. For example, the resistive heating material 322 and the conductive rings 320 may be positioned within the second passage 316 without a protective layer or coating on or around the resistive heating material 322 and the conductive rings 320.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwashing appliance, comprising:

a tub defining a wash chamber;

at least one spray-arm assembly positioned within the wash chamber;

a fluid circulation system configured to deliver fluid to the at least one spray-arm assembly;

a heating assembly positioned outside of the tub, the heating assembly comprising:

a housing; and a tubular heating element disposed within the housing, the tubular heating element comprising glass that defines an inner surface, the tubular heating element defining an an outer surface, the inner surface of the tubular heating element defining a first passage in fluid communication with the fluid circulation system, the outer surface of the tubular heating element spaced apart from an inner surface of the housing such that a second passage is defined between the outer surface of the tubular heating element and the inner surface of the housing, the second passage in fluid communication with the tub, a resistive heating material disposed on the outer surface of the tubular heating element, wherein the resistive heating material is configured to provide thermal energy to the first passage and the second passage.

2. The dishwashing appliance of claim 1, further comprising a plurality of conductive rings on the outer surface of the tubular heating element, wherein the resistive heating material extends between the conductive rings and the conductive rings are connected to a power source.

3. The dishwashing appliance of claim 2, wherein the resistive heating material and the conductive rings are exposed to the second passage.

4. The dishwashing appliance of claim 2, wherein the conductive rings are configured to provide an equally distributed voltage to the resistive heating material.

5. The dishwashing appliance of claim 2, wherein the conductive rings comprise a metallic material.

6. The dishwashing appliance of claim 2, wherein the conductive rings comprise chrome.

7. The dishwashing appliance of claim 1, further comprising a fan in operative communication with the second passage.

8. A heating assembly, comprising:

a housing; and a tubular heating element disposed within the housing, the tubular heating element comprising glass that defines an inner surface, the tubular heating element defining an an outer surface, the inner surface of the tubular heating element defining a first passage through which fluid flows in contact with the inner surface, the outer surface of the tubular heating element spaced apart from an inner surface of the housing such that a second passage is defined between the outer surface of the tubular heating element and the inner surface of the housing;

a resistive heating material disposed on the outer surface of the tubular heating element, wherein the resistive heating material is configured to provide thermal energy to the first passage and the second passage.

9. The heating assembly of claim 8, further comprising a plurality of conductive rings on the outer surface of the tubular heating element, wherein the resistive heating material extends between the conductive rings and the conductive rings are connected to a power source.

10. The heating assembly of claim 9, wherein the resistive heating material and the conductive rings are exposed to the second passage.

11. The heating assembly of claim 9, wherein the conductive rings are configured to provide an equally distributed voltage to the resistive heating material.

12. The heating assembly of claim 9, wherein the conductive rings comprise a metallic material.

13. The heating assembly of claim 9, wherein the conductive rings comprise chrome.

14. The heating assembly of claim 8, further comprising a fan in operative communication with the second passage.

* * * * *